US005349365A

United States Patent [19]

Ow et al.

[11] Patent Number: 5,349,365

[45] Date of Patent: Sep. 20, 1994

[54] QUADRIFILAR HELIX ANTENNA

[76] Inventors: Steven G. Ow, 1130 Coventry Dr., Thousand Oaks, Calif. 93065; Peter J. Connolly, 1461 Paul St., Simi Valley, Calif. 91360

[21] Appl. No.: 779,895

[22] Filed: Oct. 21, 1991

[51] Int. Cl.[5] ..... H01Q 11/08; H01Q 1/36

[52] U.S. Cl. ..... 343/895; 333/26; 343/859; 343/863

[58] Field of Search ..... 343/895, 821, 850, 857, 343/859, 860, 862, 863; 333/26; H01Q 1/34–1/36, 11/04–11/10

[56] References Cited

U.S. PATENT DOCUMENTS

| | | | |
|---|---|---|---|
| 4,008,479 | 2/1977 | Smith | 343/895 |
| 4,114,164 | 9/1978 | Greiser | 343/895 |
| 4,636,802 | 1/1987 | Middleton, Jr. | 343/895 |
| 4,697,192 | 9/1987 | Hofer et al. | 343/895 |

FOREIGN PATENT DOCUMENTS

| | | | |
|---|---|---|---|
| 0320404 | 6/1989 | European Pat. Off. | 343/895 |
| 0082803 | 4/1987 | Japan | H01Q 11/04 |

*Primary Examiner*—Rolf Hille
*Assistant Examiner*—Peter Toby Brown
*Attorney, Agent, or Firm*—Benman, Collins & Sawyer

[57] ABSTRACT

An improved helix antenna including a single unitary antenna having plural radiating elements extending radially from a common junction. A microstrip balun is connected to the plural antenna elements at the common junction. In a particular embodiment, the antenna includes four radiating elements arranged in a helical pattern and mounted such that a longitudinal axis extending through the axial center of the antenna is coincident with a longitudinal axis of the microstrip balun. One or more of the radiating elements includes a semicircular loop to create phase relationships necessary for a circularly polarized beam pattern. The microstrip balun includes a transmission line and a ground plane on opposite sides of a dielectric substrate. The transmission line and the ground plane are tapered for impedance matching between the input and the output thereof.

4 Claims, 3 Drawing Sheets

FIG. 1 PRIOR ART
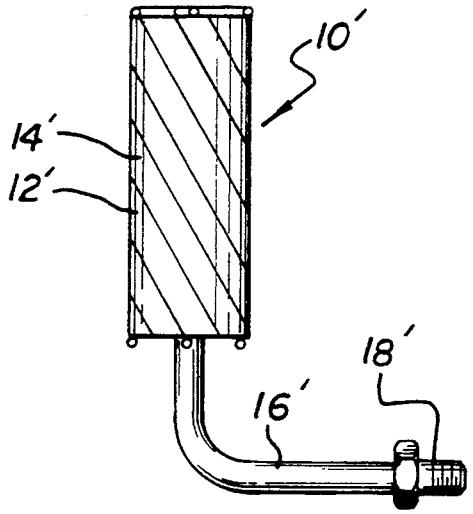
FIG. 2 PRIOR ART
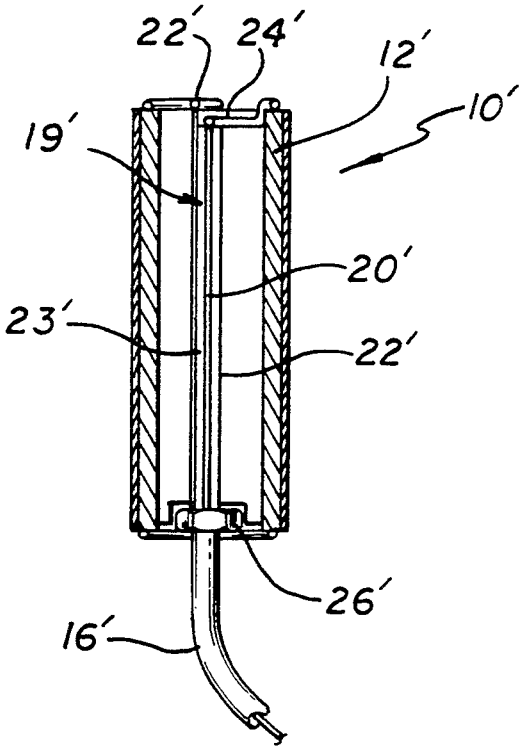
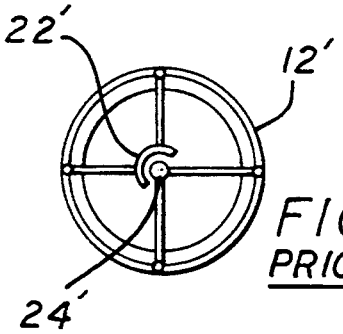
FIG. 3
PRIOR ART
FIG. 4
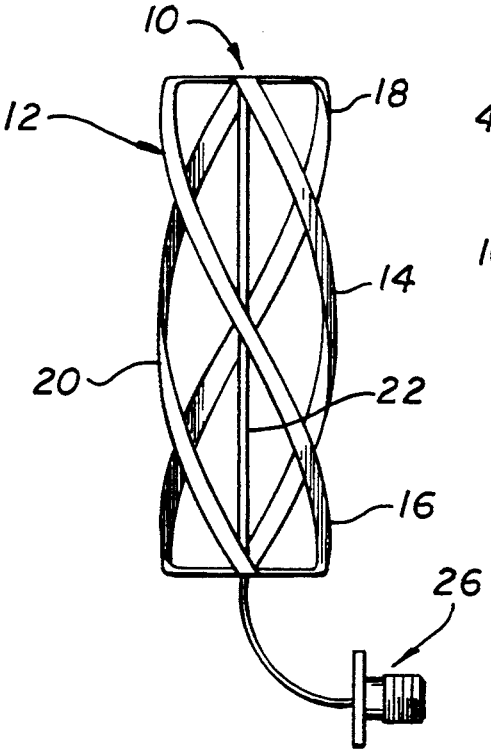
FIG. 5
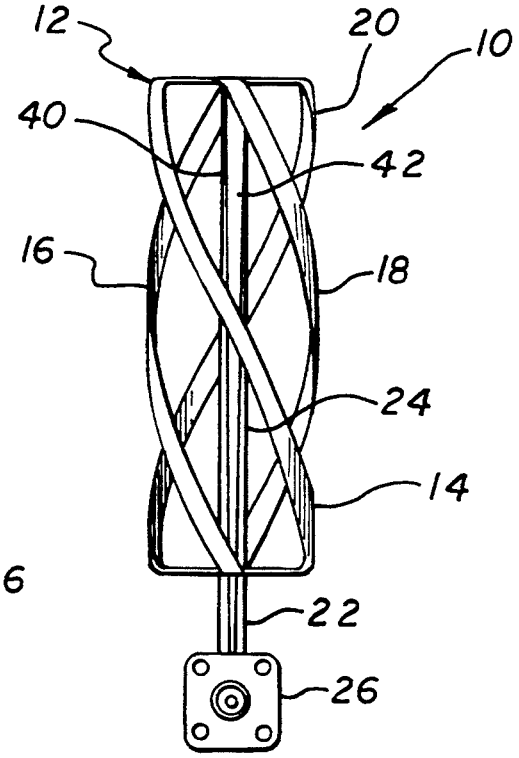

FIG. 6
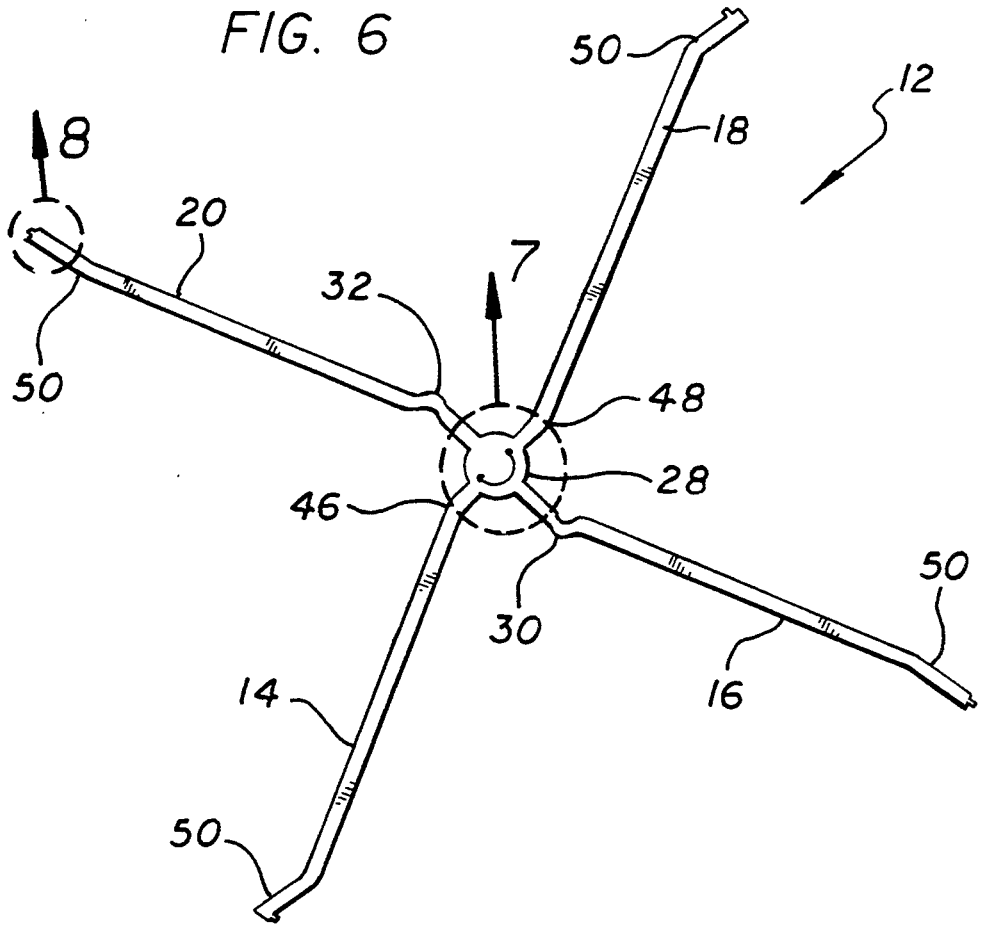
FIG. 7
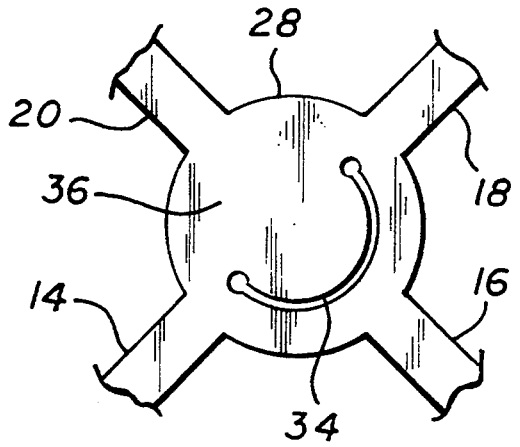
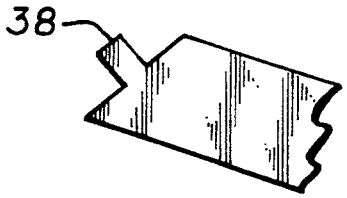
FIG. 8
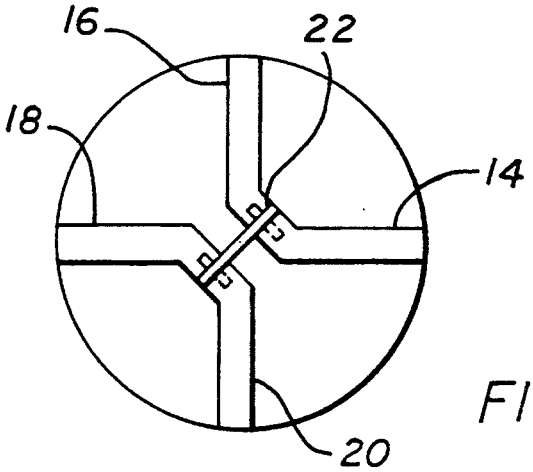
FIG. 9

QUADRIFILAR HELIX ANTENNA

BACKGROUND OF THE INVENTION

1. Field of the Invention

The present invention relates to antennas. More specifically, the present invention relates to quadrifilar helix antennas.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

2. Description of the Related Art

The Global Positioning System (GPS) provides accurate position information in three dimensions (latitude, longitude, altitude). Position location is facilitated by a constellation of satellites. Each GPS satellite continuously transmits precise time and position data. GPS receivers read signals transmitted from three or more satellites and calculate the user's position based on the distance therefrom. In addition to position information, other navigation information may be calculated including, range, bearing to destination, speed and course over ground, velocity, estimated time of arrival and cross track error. The accuracy of the calculation is dependent on the quality of the signal detected from the satellite. Hence, the system requires a sufficiently accurate receiver and antenna arrangement. Specifically, the antenna must be small and portable with an omnidirectional beam pattern broad enough to detect signals from satellites located anywhere in the hemisphere. For this purpose, the quadrifilar helix antenna has been found to be well suited.

As discussed in Antenna Engineering Handbook, by Richard C. Johnson and Henry Jasik, pp. 13–19 through 13–21 (1984) a quadrifilar helix (or volute) antenna is a circularly polarized antenna having four orthogonal fractional-turn (one fourth to one turn) helixes excited in phase quadrature. Each helix is balun-fed at the top, and the helical arms are wires or metallic strips (typically four in number) of resonant length ($1=m\lambda/4$, $m=1, 2, 3, \ldots$) wound on a small diameter with a large pitch angle. This antenna is well suited for various applications requiring a wide hemispherical beam pattern over a relatively narrow frequency range.

In accordance with conventional wisdom, quadrifilar helix antennas are constructed of several pieces (e.g. 13) typically soldered by hand at numerous joints. The antennas are typically mass produced by unskilled labor. As a result, quadrifilar helix antennas constructed in accordance with conventional teachings are expensive to fabricate, nonrepeatable in design and therefore require hand tuning. In particular, conventional quadrifilar antennas have a coax feed which has a varied distance between the inside diameter and outside diameter to match the 50 ohm typical input impedance to 30 ohm typical feed output impedance for optimum power transfer into the antenna elements. This requires machining and hand assembly which complicates the design and increases the cost of construction.

Thus, there is a need in the art for a quadrifilar antenna design that allows for low construction and testing costs.

SUMMARY OF THE INVENTION

The need in the art is addressed by the improved helix antenna of the present invention. In a most general sense, the invention includes a single unitary antenna having plural radiating elements extending radially from a common junction. A microstrip balun/impedance transformer is connected to the plural antenna elements at the common junction. In a particular embodiment, the antenna includes four radiating elements arranged in a helical pattern and mounted such that a longitudinal axis extending through the axial center of the antenna is coincident with a longitudinal axis of the microstrip balun. Two of the radiating elements include delay lines (i.e., a semi-circular loop) to create phase relationships necessary for a circularly polarized beam pattern. The microstrip balun/impedance transformer includes a transmission line and a ground plane on opposite sides of a dielectric substrate. The transmission line and the ground plane are tapered for impedance matching between the input and the output thereof.

BRIEF DESCRIPTION OF THE DRAWINGS

FIG. 1 is a front elevational view of a quadrifilar helix antenna constructed in accordance with conventional teachings.

FIG. 2 is a sectional view of a quadrifilar helix antenna constructed in accordance with conventional teachings.

FIG. 3 is a simplified top view of the quadrifilar helix antenna constructed in accordance with conventional teachings.

FIG. 4 is a side view of a quadrifilar helix antenna constructed in accordance with the teachings of the present invention.

FIG. 5 is a front view of the quadrifilar helix antenna constructed in accordance with the teachings of the present invention.

FIG. 6 is an isolated top view of the antenna element of the quadrifilar helix antenna constructed in accordance with the teachings of the present invention.

FIG. 7 is a detail view of the junction of the radiating element of FIG. 6.

FIG. 8 is a detail view of the end of a radiating element of the antenna element of the quadrifilar helix antenna constructed in accordance with the teachings of the present invention.

FIG. 9 is a detail view showing how the ends of the radiating elements of the antenna element of the quadrifilar helix antenna constructed in accordance with the teachings of the present invention.

DESCRIPTION OF THE INVENTION

Figure 10:
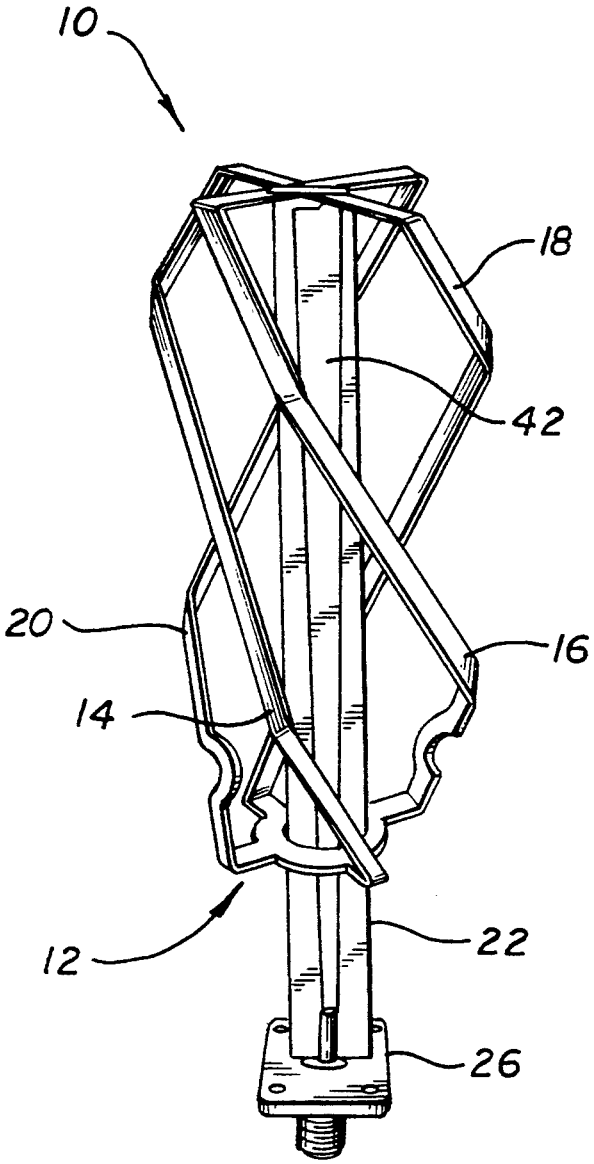
FIG. 10 is a perspective view of the quadrifilar helix antenna constructed in accordance with the teachings of the present invention.

Illustrative embodiments and exemplary applications will now be described with reference to the accompanying drawings to disclose the advantageous teachings of the present invention.

FIG. 1 is a front elevational view of a quadrifilar helix antenna 10′ constructed in accordance with conventional teachings. The antenna 10′ includes a piece of printed circuit board 12′ formed in a cylindrical shape, on which four radiating elements 14′ are disposed by etching, deposition or other conventional process. The radiating elements 14′ are fed at the top of the antenna 10′ by a coaxial transmission line 16′ from a coaxial connector 18′.

As illustrated in sectional view of FIG. 2, the coaxial transmission line is electrically connected to a balun-/impedance transformer 20′ which extends along the longitudinal axis of the board 12′ to the top thereof at which an electrical connection is effected to each of the radiating elements 14′. The manner by which the connections are made is illustrated in the simplified top view of FIG. 3. Two of the radiating elements 14′ (not shown) are soldered to the outer conductor 22′ of the balun/impedance transformer 20′ and the remaining two radiating elements (also not shown) are connected to the tapered center conductor 24′ of the balun/impedance transformer 20′. This is illustrated in FIG. 2. The bottom ends of the radiating elements 14′ are soldered to a machined ring 26′ on the balun/impedance transformer 20′.

Thus, it is apparent that conventional quadrifilar helix antenna construction requires six solder connections at the top thereof, six at the bottom and two at the connector interface for a minimum of 14 solder connections.

As is well known in the art, the piecework and necessity for multiple solder connections requires costly hand work with labor equipped, at least, with soldering skills. In addition, the solder connections are characteristically nonrepeatable further requiring costly testing and retuning.

The quadrifilar antenna design of the present invention provides a simple low cost alternative conventional quadrifilar antenna designs. FIG. 4 is a side view and FIG. 5 is a front view of a quadrifilar helix antenna 10 constructed in accordance with the teachings of the present invention. The antenna 10 includes a unitary antenna element 12 and a microstrip balun/impedance transformer 22. The antenna element 12 is cut or stamped from a thin sheet of copper or other suitable conductor. In the illustrative embodiment, the antenna element 12 includes first, second, third and fourth radiating elements 14, 16, 18 and 20 respectively. FIG. 6 is a top view of the antenna element 12 showing the radiating elements 14, 16, 18 and 20 radially extending from a common junction 28. Note the loops 30 and 32 provided in the second and fourth radiating elements 16 and 20 respectively- The loops extend the length of the radiating element and thereby create a reactive component to feed the radiating arms in phase quadrature thereby producing circular polarization.

As illustrated in the detail view of FIG. 7, the common junction 28 is a radial hub within which a semi-circular slot 34 is cut. The slot 34 allows the tab 36 to be pushed up to provide an aperture and grounding solder/point for the microstrip balun/impedance transformer 22 to the antenna element. As illustrated in the detail view of FIG. 8, the free ends of the radiating elements include a tab 38. The edge of each radiating element serves to provide a landing 39. The landing 39 is significant because it self-indexes the element arms and maintains a constant phase differential between pairs of element arms. That is, when the tab 38 is fully inserted into the balun and seated against the landing 39, the landing phase delay is maintained. If there were no landing, the ends of the radiating elements would seat at various distances thereby changing the phase differential between element arms. As shown in the detail view of FIG. 9, the tabs 38 are fed through holes in the microstrip balun/impedance transformer 22 from opposing sides thereof, at which point the radiating elements are soldered to the microstrip balun/impedance transformer 22. These solder joints construct the antenna elements into a mechanically rigid structure.

Returning to FIG. 4, the antenna element 12 is fed by a microstrip balun/impedance transformer 22. The microstrip balun/impedance transformer is connected to a coax connector 26 on one end and to the antenna element 12 on the other. The microstrip balun/impedance transformer 22 is a thin strip of dielectric material 40 of teflon and fiberglass or other suitable material. The dielectric has a tapered transmission line 42 deposited on one side and a tapered ground plane 44 (not shown) deposited on the other.

The transmission line 42 is illustrated in the front view of FIG. 5. In the illustrative embodiment, the tapers of the transmission line 42 and the ground plane 44 are designed to provide a 50 ohm coax input impedance and a 30 ohm antenna output impedance for optimum power transfer.

FIG. 10 is a perspective view of the quadrifilar helix antenna 10 of the present invention.

In construction, the microstrip balun/impedance transformer 22 is inserted through the aperture in the junction 28 of the antenna element 12. The radiating elements are folded at the loops 30 and 32 and at the bends 46, 48 and 50 (FIG. 6) into the helical shape of FIGS. 4 and 5. The tabs 38 of the radiating elements extend through apertures in the dielectric 40 and the element self-index landing 39 accurately locates the element position as illustrated in FIG. 9. The transmission line 42 is shaped at the top of the dielectric 40 so that it may be solder connected to the tabs of two of the antenna radiating elements (e.g., 14 and 16) on one end thereof on one side of the dielectric 40. At the other end, the transmission line 42 is soldered to the center conductor of the coax connector 26 (See FIG. 10). The ground plane 44 is shaped at the top of the dielectric 40 so that it may be solder connected to the tabs of the remaining two antenna radiating elements (e.g., 18 and 20) on one end thereof.

At the other end, the ground plane 44 is connected to the outer conductor of the coax connector 26. Tab 36 of the antenna element 12, shown in FIG. 7, is soldered to the ground plane 44 of microstrip balun/impedance transformer 22. That is, the common junction 28 at the bottom of the antenna 10 is soldered to the ground plane 44 at the tab 36. The four free (distal) ends of the antenna elements are soldered at the top of the antenna to the balun/impedance transformer 22. Two adjacent arms 14 and 16 are soldered to the transmission line 42 and the other two elements 18 and 20 are soldered to the ground plane 44. Hence, only 5 solder connections are required.

Figure 11:
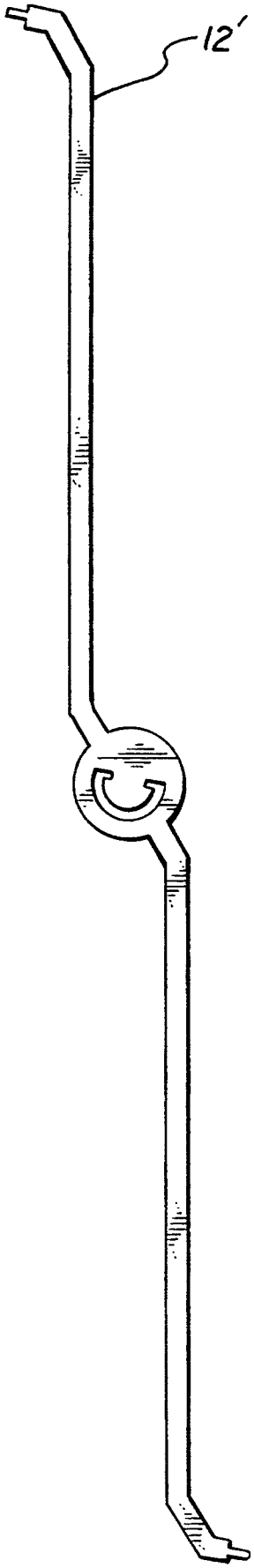
FIG. 11 is an isolated top view of an alternative embodiment of the antenna element of the quadrifilar helix antenna constructed in accordance with the teachings of the present invention.

FIG. 11 is an isolated top view of an alternative embodiment of the antenna element of the quadrifilar helix antenna 12′ constructed in accordance with the teachings of the present invention. An antenna constructed in accordance with this design would employ two such antenna elements 12′ to provide a complete antenna. The antenna 12′ is otherwise constructed in the same manner as the antenna 12 of FIG. 6.

Thus, the present invention has been described herein with reference to a particular embodiment for a particular application. Those having ordinary skill in the art and access to the present teachings will recognize additional modifications applications and embodiments within the scope thereof. For example, the invention is not limited to construction in a helical pattern. Nor is the invention limited to four radiating elements. Any number of radiating elements may be used within the scope of the present teachings.

It is therefore intended by the appended claims to cover any and all such applications, modifications and embodiments within the scope of the present invention.

We claim:

1. An improved quadrifilar helix antenna comprising:

a unitary antenna having at least two radiating elements extending radially from a common junction and a microstrip balun connected to said plural antenna elements at said common junction, wherein said radiating elements are joined at distal ends thereof, arranged in a helical pattern, and mounted such that a longitudinal axis extending through the axial center of the antenna is coincident with a longitudinal axis of said microstrip balun and each of said antenna elements includes a tab at said distal end thereof adapted to engage a slot in said microstrip balun.

2. The invention of claim 1 wherein one or more of said antenna elements includes a semi-circular loop extending the length of said antenna element.

3. The invention of claim 1 wherein said balun includes a microstrip transmission line and a ground plane on opposite sides of a dielectric substrate.

4. The invention of claim 3 wherein said transmission line is tapered.

* * * * *